US009039850B2

(12) United States Patent
Takemura

(10) Patent No.: US 9,039,850 B2
(45) Date of Patent: May 26, 2015

(54) ALUMINUM ALLOY MATERIAL FOR FORGING

(75) Inventor: Hideki Takemura, Kitakata (JP)

(73) Assignee: Showa Denko K.K., Tokyo (JP)

( * ) Notice: Subject to any disclaimer, the term of this patent is extended or adjusted under 35 U.S.C. 154(b) by 1243 days.

(21) Appl. No.: 12/809,130

(22) PCT Filed: Dec. 12, 2008

(86) PCT No.: PCT/JP2008/072663

§ 371 (c)(1),
(2), (4) Date: Nov. 19, 2010

(87) PCT Pub. No.: WO2009/081770

PCT Pub. Date: Jul. 2, 2009

(65) Prior Publication Data

US 2011/0198003 A1 Aug. 18, 2011

(30) Foreign Application Priority Data

Dec. 21, 2007 (JP) ..... 2007-330067

(51) Int. Cl.

| | |
|---|---|
| ***C22F 1/057*** | (2006.01) |
| ***B21J 5/00*** | (2006.01) |
| ***B21K 1/76*** | (2006.01) |

(Continued)

(52) U.S. Cl.

CPC . *C22F 1/057* (2013.01); *B21J 5/00* (2013.01); *B21K 1/76* (2013.01); *C22C 21/14* (2013.01); *C22C 21/16* (2013.01)

(58) Field of Classification Search

CPC ..... C22F 1/057; B21J 5/00
USPC ..... 148/551, 552, 694, 695–700
IPC ..... C22F 1/057
See application file for complete search history.

(56) References Cited

FOREIGN PATENT DOCUMENTS

| | | | |
|---|---|---|---|
| JP | 04-000353 A | | 1/1992 |
| JP | 04000353 A | * | 1/1992 |
| JP | 06-240420 A | | 8/1994 |

(Continued)

OTHER PUBLICATIONS

"Aluminum and Aluminum Alloys", ASM International, 1993, p. 41, 222, 248, 293.*

(Continued)

*Primary Examiner* — Roy King
*Assistant Examiner* — Janelle Morillo
(74) *Attorney, Agent, or Firm* — Keating & Bennett, LLP

(57) ABSTRACT

An aluminum alloy forging material of the present invention is constituted by an aluminum alloy cast product obtained by subjecting an aluminum alloy ingot having a structure in which a secondary dentrite arm spacing (DAS) is 40 μm or less and an average grain diameter of crystallized substances is 8 μm or less to homogenization treatment for holding the ingot for one hour or more under temperature conditions of 450 to 510° C., wherein the ingot is obtained by continuously casting a molten aluminum alloy having an alloy composition consisting of: Si: 0.80 to 1.15 mass %; Fe: 0.2 to 0.5 mass %; Cu: 3.8 to 5 mass %; Mn: 0.8 to 1.15 mass %; Mg: 0.5 to 0.8 mass %; Zr: 0.05 to 0.13 mass %; and Ti contained in such an amount that a sum of Ti and Zr is 0.2 mass % or less, and the balance being Al and inevitable impurities, wherein the alloy composition satisfies a Cu/Mg ratio of 8 or less, Ti is added in a form of an Al master alloy (5Ti-1B mother alloy) in which Ti and B are contained at a ratio of 5:1, and a Ti/Zr ratio satisfies 0.3 or higher.

1 Claim, 1 Drawing Sheet

(51) Int. Cl.
*C22C 21/14* (2006.01)
*C22C 21/16* (2006.01)

(56) References Cited

FOREIGN PATENT DOCUMENTS

JP 06-256880 A 9/1994
JP 2003-138357 A 5/2003
JP 2003-277868 A 10/2003

OTHER PUBLICATIONS

Database WP I, Week 200364, Thomson Scientific, London, GB; AN 2003-674238; XP02664238, 2003.

* cited by examiner

ALUMINUM ALLOY MATERIAL FOR FORGING

TECHNICAL FIELD

The present invention relates to Al—Cu—Mg series aluminum alloy forging material capable of obtaining an aluminum alloy forged product excellent in strength and surface color tone, and also relates to its related technology.

TECHNICAL BACKGROUND

In recent years, in motorcycle structural parts or the like required to have a certain strength, aluminum alloy forged products have been widely used to trim the weight.

It is well known that motorcycle parts or the like have been produced by subjecting an extrude article made of, e.g., a JIS 2014 alloy, to forging. In the case of an ordinary JIS 2014 alloy extruded article, coarse recrystallization occurs at the step of heat treatment called T6 (T6 heat treatment) performed after forging, and the subsequent acid cleaning causes appearance of macro patters on the product surface. To solve this problem, as shown in the following Patent Document 1, in the case of parts used at portions which readily attract public attention, surface treatment, such as, e.g., shotblasting, is performed after the acid cleaning.

[Patent Document 1] Japanese Unexamined Laid-open Patent Application Publication H06-240420 (see claims and FIG. 1)

DISCLOSURE OF THE INVENTION

Problems to be Solved by the Invention

In a conventional forged product shown in the aforementioned Patent Document 1, however, since the surface macro patterns are erased by surface treatment such as shotblasting, the surface treatment causes problems, e.g., deterioration in productivity and/or increase in production cost.

Furthermore, in the case of a forged product manufactured using JIS A2014 alloy, although the forged product exhibits high stretching properties in a direction parallel to the extrusion direction of an extruded article as a forging material, there are another problem that the mechanical strength is insufficient, for example, the stretching properties in a direction perpendicular to the extrusion direction deteriorate. Therefore, in order to prevent occurrence of tear fracture in a direction perpendicular to the extrusion direction, it is required to design so as to increase the dimension in the direction. This, however, results in an increased weight, which is not suitable for motorcycle parts or the like which are required to be light in weight.

The preferred embodiments of the present invention have been developed in view of the aforementioned problems and/or other problems in the related art. The preferred embodiments of the present invention can significantly improve upon existing methods and/or apparatuses.

The present invention was made in view of the aforementioned problems, and aims to provide an aluminum alloy material for forging, or an aluminum alloy forging material, capable of obtaining a forged product excellent in surface color tone and having sufficient strength while improving the productivity and reducing the production cost, and also aims to provide its related technology.

Other objects and advantages of the present invention will be apparent from the following preferred embodiments.

Means for Solving the Problems

In order to attain the aforementioned objects, the present invention is summarized to have the following structure.

[1] An aluminum alloy forging material constituted by an aluminum alloy cast product obtained by subjecting an aluminum alloy ingot having a structure in which a secondary dentrite arm spacing (DAS) is 40 μm or less and an average crystal grain diameter of crystallized substances is 8 μm or less to homogenization treatment for holding the ingot for one hour or more under temperature conditions of 450 to 510° C., wherein the ingot is obtained by continuously casting a molten aluminum alloy having an alloy composition consisting of: Si: 0.80 to 1.15 mass %; Fe: 0.2 to 0.5 mass %; Cu: 3.8 to 5 mass %; Mn: 0.8 to 1.15 mass %; Mg: 0.5 to 0.8 mass %; Zr: 0.05 to 0.13 mass %; and Ti contained in such an amount that a sum of Ti and Zr is 0.2 mass % or less, and the balance being Al and inevitable impurities, wherein the alloy composition satisfies a Cu/Mg ratio of 8 or less, Ti is added in a form of an Al master alloy (5Ti-1B mother alloy) in which Ti and B are contained at a ratio of 5:1, and a Ti/Zr ratio satisfies 0.3 or higher.

[2] An aluminum alloy forged product obtained by subjecting the aluminum alloy forging material as recited in the aforementioned Item 1 to hot forging under temperature conditions of 400 to 510° C.

[3] An aluminum alloy forged product obtained by subjecting the aluminum alloy forging material as recited in the aforementioned Item 1 to hot forging and further subjecting the aluminum alloy forging material to solution treatment under temperature conditions of 450 to 510° C.

[4] A method of manufacturing an aluminum alloy forging material, comprising:

a step of obtaining an aluminum alloy ingot having a structure in which a secondary dentrite arm spacing (DAS) is 40 μm or less and an average grain diameter of crystallized substances is 8 μm or less by continuously casting a molten aluminum alloy having an aluminum composition consisting of: Si: 0.80 to 1.15 mass %; Fe: 0.2 to 0.5 mass %; Cu: 3.8 to 5 mass %; Mn: 0.8 to 1.15 mass %; Mg: 0.5 to 0.8 mass %; Zr: 0.05 to 0.13 mass %; and Ti contained in such an amount that a sum of Ti and Zr is 0.2 mass % or less, and the balance being Al and inevitable impurities, wherein the alloy composition satisfies a Cu/Mg ratio of 8 or less, Ti is added in a form of a 5Ti-1B mother alloy, and Ti/Zr ratio satisfies 0.3 or higher; and a step of obtaining an aluminum alloy cast product by subjecting the aluminum alloy ingot to homogenization treatment for holding the product for one hour or more at temperatures of 450 to 510° C., wherein the aluminum alloy cast product is constituted as the aluminum alloy forging material.

[5] A method of manufacturing an aluminum alloy forged product, wherein the aluminum alloy forged product is obtained by subjecting the aluminum alloy forging material obtained by the manufacturing method as recited in the aforementioned Item 4 to hot forging under temperature conditions of 400 to 510° C.

[6] A method of manufacturing an aluminum alloy forged product, wherein the aluminum alloy forged product is obtained by subjecting the aluminum alloy cast material obtained with the manufacturing method as recited in the aforementioned Item 4 to hot forging, and thereafter further subjecting it to solution treatment under temperature conditions of 450 to 510° C.

Effects of the Invention

According to the aluminum alloy forging material of the invention [1], a forged product excellent in surface color tone and having sufficient strength can be obtained while improving the production efficiency and reducing the production cost.

According to the invention [2], in the same manner as mentioned above, a forged product excellent in surface color tone and having sufficient strength can be obtained while improving the production efficiency and reducing the production cost.

According to the invention [3], a forged product higher in strength can be provided.

According to the manufacturing method of an aluminum alloy forging material of the invention [4], a forged product having the same functions and effects as mentioned above can be obtained.

According to the invention [5] and [6], a forged product having the same functions and effects as mentioned above can be obtained.

BEST MODE FOR CARRYING OUT THE INVENTION

Figure 1:
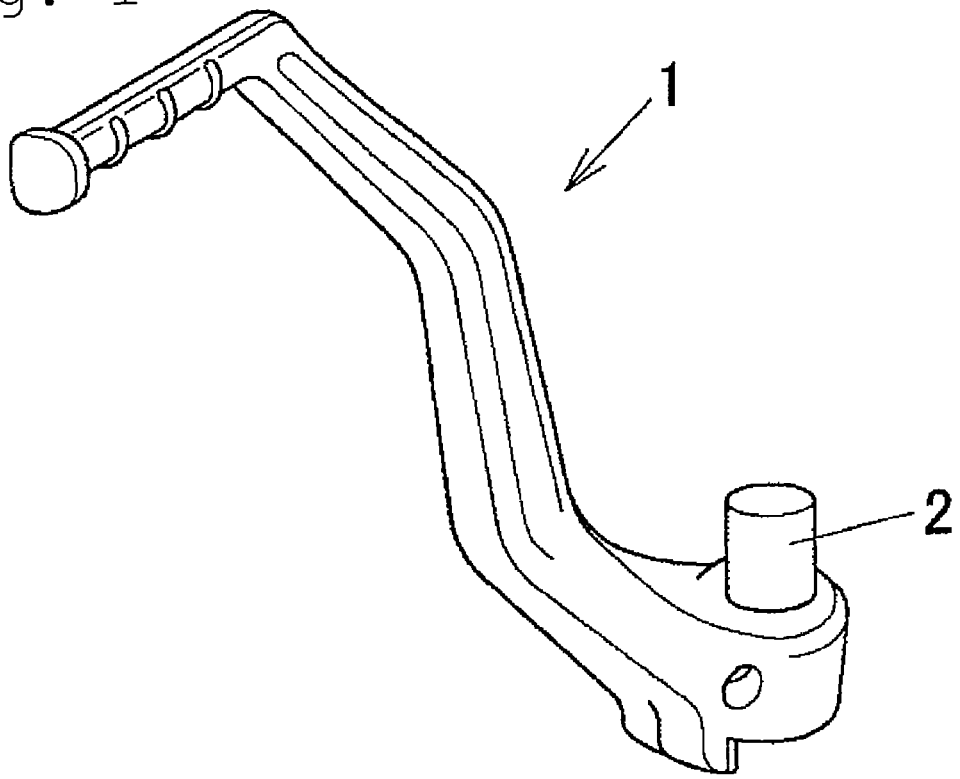
FIG. 1 is a perspective view showing an example of an aluminum alloy forged product.

The aluminum alloy forging material according to the present invention is constituted by an aluminum alloy cast product.

The aluminum alloy cast product is produced by subjecting an aluminum alloy ingot obtained by continuously casting molten aluminum alloy having a specific composition to certain heat treatment (homogenization treatment).

In the present invention, the composition of the molten aluminum alloy (ingot) includes Si, Fe, Cu, Mn, Mg, Zr, Ti containing in a form of 5Ti-1B mother alloy (in the form of an Al master alloy containing Ti and B at a ratio of 5:1), and the balance being Al and inevitable impurities.

Hereinafter, each component and content (mass %) of the alloy composition will be detailed.

Si is an element for improving mechanical strength when coexisted with Cu and Mg. In order to assuredly attain the effect, it is necessary to adjust the Si content so as to fall within the range of 0.80 to 0.15 mass.

If Si content is less than 0.80 mass %, the aforementioned effect cannot be obtained sufficiently. On the other hand, if the content exceeds 1.15 mass %, Al—Si coarse recrystallized substances will be increased, which may cause deterioration of the plastic working workability during the forging, or which may cause deterioration of the ductility, toughness, and/or fatigue strength of the product after the forging, and therefore it is not preferable.

Fe is an element which prevents fracture of an ingot during the casting and prevents coarse recrystallization. In order to assuredly obtain these effects, it is necessary to adjust the Fe content so as to fall within the range of 0.2 to 0.5 mass %.

If the Fe content is less than 0.2 mass %, the aforementioned effects cannot be obtained sufficiently. On the other hand, if the content exceeds 0.5 mass %, Al—Fe—Mn series coarse crystals increase, which may cause deterioration of the plastic working workability during the forging, or which may cause deterioration of the ductility, toughness, and/or fatigue strength of the product after the forging, and therefore it is not preferable.

Cu is an element which causes precipitation of $CuAl_2$ particles and also causes precipitation of $CuMgAl_2$ particles when coexisted with Mg to thereby enhance the mechanical strength. In order to obtain these effects assuredly, it is necessary to adjust the Cu content so as to fall within the range of 3.8 to 5 mass %.

If the Cu content is less than 3.8 mass %, the aforementioned effects cannot be obtained sufficiently. On the other hand, if the content exceeds 5 mass %, Al—Cu—Mg series coarse crystals increase, which may cause deterioration of the plastic working workability during the forging, or which may cause deterioration of the ductility, toughness, and/or fatigue strength of the product after the forging, and therefore it is not preferable.

Mn is an element which prevents coarse recrystallization. In order to assuredly obtain the effect, it is necessary to adjust the Mn content so as to fall within the range of 0.8 to 1.15 mass %.

If the Mn content is less than 0.8 mass %, the aforementioned effect cannot be obtained sufficiently. On the other hand, if the content exceeds 1.15 mass %, Al—Fe—Mn series coarse crystals increase, which may cause deterioration of the plastic working workability during the forging, or which may cause deterioration of the ductility, toughness, and/or fatigue strength of the product after the forging, and therefore it is not preferable.

Mg is an element which causes precipitation of $CuMgAl_2$ particles when coexisted with Cu to thereby enhance the mechanical strength. In order to obtain the effect assuredly, it is necessary to adjust the Mg content so as to fall within the range of 0.5 to 0.8 mass %.

If the Mg content is less than 0.5 mass %, the aforementioned effect cannot be obtained sufficiently. On the other hand, if the content exceeds 0.8 mass %, Al—Cu—Mg series coarse crystals increase, which may cause deterioration of the plastic working workability during the forging, or which may cause deterioration of the ductility, toughness, and/or fatigue strength of the product after the forging, and therefore it is not preferable.

Zr is an element which prevents coarse recrystallization. In order to assuredly obtain the effect, it is necessary to adjust such that the Zr content by itself falls with in the range of 0.05 to 0.13 mass % and that the total content of Zr and Ti becomes 0.2 mass % or less. That is, if the Zr content is less than 0.05 mass %, the aforementioned effect cannot be obtained sufficiently, and therefore it is not preferable. On the other hand, if the Zr content is excessive, it is also not preferable because of the following reasons.

If the Zr content is excessive, a large amount of Zr reacts with B contained in $TiB_2$, which is added in the form of 5Ti-1B mother alloy for the purpose of miniaturizing the crystal grains during the casting, to create $ZrB_2$, which prevents the miniaturization of crystals. This necessitates to add a large amount of $TiB_2$. However, $TiB_2$ and $ZrB_2$ are hard particles, which may shorten a cutting tool life during the cutting work of a product. For this reason, it is not preferable to add a large amount of Zr. Specifically, it is preferable that the Zr additive amount is 0.13 mass % or less and that the total additive amount of Ti and Zr is 0.2 mass % or less.

In the present invention, it is necessary to adjust the Cu/Mg ratio of Cu and Mg as components to 8 or less.

In detail, depending on the additive proportion of Cu and Mg, a region where only $CuAl_2$ particles exist ($CuAl_2$ single-phase region) and a region where $CuAl_2$ particles and $CuMgAl_2$ particles coexist ($CuAl_2$+$CuMgAl_2$ two-phase region) are formed. Among these, in the Al alloy in the Cu—Al2 single-phase region, the mechanical strength deteriorates significantly as compared with the Al alloy in the Cu—$Al_2$+$CuMgAl_2$ two-phase region. These regions, however, change depending on the Cu/Mg ratio. Specifically, when the Cu/Mg ratio is 8 or more, it becomes a $CuAl_2$ single-phase region. When the Cu/Mg ratio is leas than 8, it becomes a $CuAl_2$+$CuMgAl_2$ two-phase region. Therefore, it is preferable to control the additive amount of Cu and Mg so that the Cu/Mg ratio becomes 8 or less.

Furthermore, in the present invention, it is necessary to adjust the Ti/Zr ratio of Ti and Zr as components to 0.3 or more.

In detail, Ti is added as 5Ti-1B mother alloy, and it is necessary to adjust the Ti/Zr ratio at that time to 0.3 or more. As explained above, Zr reacts with B contained in $TiB_2$ added for the purpose of miniaturizing crystal grains to create may deteriorate crystal grain $ZrB_2$, which miniaturization. Therefore, insufficient $TiB_2$ additive amount with respect to the Zr additive amount causes coarse crystallization during the casting, which may result in deteriorated mechanical strength and deteriorated elongation. This in turn may cause fracture of an ingot during the casting. For the reasons above, it is preferable to control the Ti/Zr ratio when added as 5Ti-1B mother alloy to 0.3 or more.

The composition of the molten aluminum alloy (ingot) according to the present invention contains each of the aforementioned elements at the aforementioned ratio, and the balance being Al and inevitable impurities (unavoidable components).

In the present invention, the molten aluminum alloy having the aforementioned alloy composition is continuously casted to obtain an aluminum alloy ingot.

In the present invention, it is necessary to adjust the secondary dendrite arm spacing (DAS) of the aluminum alloy ingot to 40 μm or less.

If the DAS of the aluminum alloy ingot exceeds 40 μm, there is a possibility that the mechanical strength deteriorates and a desired high strength cannot be obtained, and therefore it is not preferable. Accordingly, in the present invention, it is preferable to adjust the DAS to 40 nm or less, more preferably 20 μm or less.

In the present invention, the DAS is measured in accordance with the "Dendrite Arm Spacing Measuring Method" described in "Light metal (1988), Vol. 38, No 1, p 45" issued by the Japan Institute of Light Metals.

In the aluminum alloy ingot of the present invention, it is necessary to adjust the average grain diameter of crystallized substances to 8 μm or less. If the average grain diameter of crystallized substances is 8 μm or less, the plastic working workability during the forging is excellent, and the ductility, toughness, and fatigue strength of the product is excellent.

In the present invention, the crystallized substance means a substance that an Al—Si series crystallized substance, an Al—Fe—Mn series crystallized substance, or an Al—Cu—Mg series crystallized substance is crystallized at a crystal grain boundary in a particle-like or flake-like manner.

In the present invention, the aforementioned aluminum alloy ingot is subjected to homogenization treatment to obtain an aluminum alloy cast product. This homogenization treatment is a treatment of holding an aluminum alloy ingot for one hour or more under temperature conditions of 450 to 510° C.

If the temperature for the homogenization treatment is lower than 450° C., the diffusion rate of solute atom is slow, causing residual of microsegregation, which may deteriorate the plastic working workability during the forging. Furthermore, even if the treatment time is less than one hour, the time required for diffusing the solute atom cannot be secured, and therefore the same problem as in the case where the treatment temperature is too low may occur. For this reason, in performing the homogenization treatment, it is necessary to hold the ingot for one hour or more under the aforementioned temperature conditions.

Furthermore, if the treatment temperature is higher than 510° C., the recrystallization preventing effect of Mn and Zr cannot be obtained, which may cause coarse recrystallization inside or at the surface of a product, and therefore it is not preferable.

Furthermore, the aluminum alloy forging material according to the present invention is constituted by the aluminum alloy cast product obtained as explained above.

Furthermore, the present invention further includes an aluminum alloy forged product obtained by subjecting the aluminum alloy forging material to forging.

That is, in the present invention, a forged product is obtained by subjecting the aluminum alloy forging material to hot forging under the temperature conditions of 400 to 510° C. In this case, the aluminum alloy forging material is not subjected to extruding, but subjected to forging.

In this hot forging, if the forging temperature is lower than 400° C., the plastic working workability during the forging deteriorates, which may make it difficult to assuredly obtain a forged product having a desired shape and also may cause damage of a forging die or fracture of a forged product. On the other hand, if the hot forging temperature is higher than 510° C., aperture defects and/or aggregation of metal low in melting point, such as, e.g., Cu, may occur at the vicinity of the surface of the forged product. Accordingly, in the present invention, the hot forging is preferably performed under the temperature conditions of 400 to 510° C.

Furthermore, in the present invention, by subjecting the aluminum alloy forged product obtained as mentioned above to solution treatment under the temperature conditions of 450 to 510° C., the mechanical strength of the forged product can be further improved.

If the temperature is lower than 450° C. at the time of the solution treatment, the solid solution amount of the precipitation strengthening element decreases, decreasing the precipitation amount at the subsequent aging treatment, which in turn may make it difficult to attain sufficient mechanical strength. On the other hand, if the temperature of the solution treatment is higher than 510° C., aperture defects and/or aggregation of metal low in melting point, such as, e.g., Cu, may occur at the vicinity of the surface of the forged product by eutectic melting. Accordingly, in the present invention, the solution treatment is preferably performed under the temperature conditions of 450 to 510° C.

As will be apparent from the following Examples, the forged product of the present invention obtained as mentioned above is excellent in mechanical strength, e.g., 0.2% yield strength, and/or elongation after fracture.

As shown in FIG. 1, in cases where the kick pedal 1 for a motorcycle is produced by subjecting the extruded article obtained by extruding an aluminum alloy forging material to forging for reference, although it exhibits high elongation in a direction parallel to the extrusion direction at the time of the extrusion, there is a tendency that the elongation in a direction perpendicular to the extrusion direction unexpectedly decreases. Therefore, in order to restrain the tear fracture of the portion of the conventional forged product (kick petal 1) into which a shaft 2 is inserted and fixed therein, it is necessary to design so that the dimension in a direction perpendicular to the extrusion direction becomes large. Thus, it is inevitable to increase the size of the shaft fixing portion, which in turn may increase the size and weight of the entire kick pedal 1.

On the other hand, the forged product (kick pedal 1) obtained in accordance with the present invention is excellent in mechanical strength, e.g., elongation after fracture. Therefore, even if the size of the shaft fixing portion is small, the tear fracture can be assuredly prevented, which in turn can reduce in size and weight of the kick pedal itself.

EXAMPLES

Figure 2:
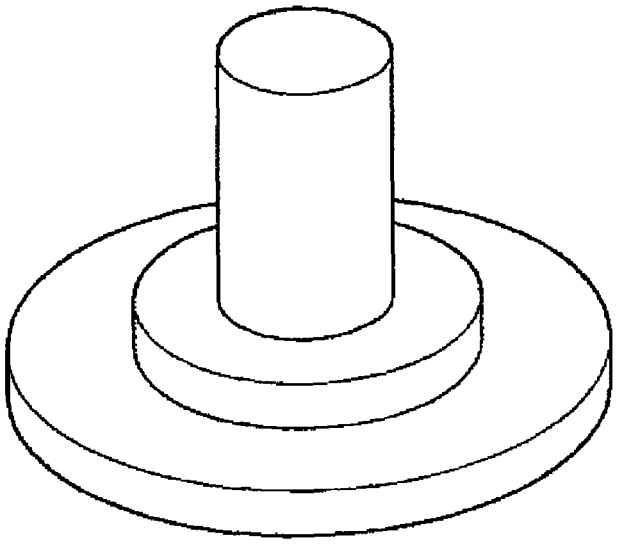
FIG. 2 is a perspective view showing an alloy sample employed in Examples and Comparative Examples.

In order to produce each sample of the following Examples 1-4 and Comparative Examples 1-11, certain additive metals were added to molten aluminum alloy, and then heated at temperatures of 800±50° C. Thereafter, it was cooled to a predetermined temperature and held, then 5Ti-1B alloy was added and held. The obtained molten aluminum alloy was casted in a casting mold to produce each disk sample (alloy sample) corresponding to each Example and each Comparative Example as shown in FIG. 2. The composition of each alloy sample was analyzed and confirmed by emission spectrochemical analysis defined by JIS (Japanese Industrial Standards) H 1305. These analysis results are shown together in Table 1.

TABLE 1

| | | Composition (mass %) Balance: Al and inevitable impurities | | | | | | | | | Material production | Homogenization | Forging | Solution treatment |
|---|---|---|---|---|---|---|---|---|---|---|---|---|---|---|
| | | Si | Fe | Cu | Mn | Mg | Ti | Zr | Cu/Mg | Ti/Zr | method | treatment | temperature | temperature |
| Example | 1 | 1.00 | 0.30 | 4.50 | 1.00 | 0.60 | 0.033 | 0.09 | 7.5 | 0.37 | Continuous casting | 470° C. × 7 h | 450° C. | 500° C. |
| | 2 | 0.90 | 0.25 | 4.75 | 0.90 | 0.75 | 0.030 | 0.08 | 6.3 | 0.38 | Continuous casting | 480° C. × 5 h | 480° C. | 495° C. |
| | 3 | 0.85 | 0.40 | 4.00 | 1.10 | 0.60 | 0.031 | 0.09 | 6.7 | 0.34 | Continuous casting | 475° C. × 6 h | 475° C. | 498° C. |
| | 4 | 1.10 | 0.45 | 4.25 | 0.95 | 0.75 | 0.022 | 0.06 | 5.7 | 0.37 | Continuous casting | 460° C. × 24 h | 475° C. | 498° C. |
| Comparative Example | 1 | 1.00 | 0.30 | 4.50 | 1.00 | 0.60 | 0.033 | 0.09 | 7.5 | 0.37 | Extrusion | 470° C. × 7 h | 450° C. | 500° C. |
| | 2 | 0.90 | 0.25 | 4.75 | 0.90 | 0.75 | 0.030 | 0.08 | 6.3 | 0.38 | Extrusion | 480° C. × 5 h | 480° C. | 495° C. |
| | 3 | 0.85 | 0.40 | 4.00 | 1.10 | 0.60 | 0.031 | 0.09 | 6.7 | 0.34 | Extrusion | 475° C. × 6 h | 475° C. | 498° C. |
| | 4 | 0.90 | 1.00 | 4.00 | 1.50 | 0.60 | 0.033 | 0.09 | 6.7 | 0.37 | Continuous casting | 470° C. × 7 h | 450° C. | 500° C. |
| | 5 | 2.25 | 0.30 | 4.75 | 0.90 | 0.75 | 0.033 | 0.09 | 6.3 | 0.37 | Continuous casting | 470° C. × 7 h | 450° C. | 500° C. |
| | 6 | 1.05 | 0.35 | 3.55 | 1.05 | 0.40 | 0.030 | 0.08 | 8.8 | 0.38 | Continuous casting | 470° C. × 7 h | 450° C. | 500° C. |
| | 7 | 1.00 | 0.30 | 4.50 | 1.00 | 0.60 | 0.033 | 0.01 | 7.5 | 3.3 | Continuous casting | 470° C. × 7 h | 450° C. | 500° C. |
| | 8 | 1.00 | 0.30 | 4.50 | 0.75 | 0.60 | 0.015 | 0.09 | 7.5 | 0.17 | Continuous casting | 470° C. × 7 h | 450° C. | 500° C. |
| | 9 | 1.00 | 0.30 | 4.50 | 1.00 | 0.60 | 0.033 | 0.09 | 7.5 | 0.37 | Continuous casting | 520° C. × 7 h | 450° C. | 500° C. |
| | 10 | 1.00 | 0.30 | 4.50 | 1.00 | 0.60 | 0.033 | 0.09 | 7.5 | 0.37 | Continuous casting | 470° C. × 7 h | 540° C. | 500° C. |
| | 11 | 1.00 | 0.30 | 4.50 | 1.00 | 0.60 | 0.033 | 0.09 | 7.5 | 0.37 | Continuous casting | 470° C. × 7 h | 450° C. | 400° C. |

Thereafter, each alloy sample in Examples and Comparative Examples was dropped in temperature to 700±50° C. Then, a round bar having a diameter of 80 mm was subjected to continuous casting using a Hot-top casting machine and cut into a certain length, and then subjected to homogenization treatment under temperature conditions shown in Table 1 to obtain a continuous cast round bar as a cast article. Thereafter, the continuous cast round bar is cut to obtain a forged material.

Next, alloy samples (forging material) in Examples 1-4 and Comparative Examples 4-11 were preliminary heated under forging temperature conditions shown in Table 1, and then subjected to upset forging (hot forging) from the round bar side surface direction to a thickness of 20 mm. Subsequently, the upset article (forged article) was subjected to solution treatment under the temperature conditions shown in Table 1, then water-cooled, and then subjected to aging treatment for eight hours at 180° C.

On the other hand, alloy samples (forging material) in Comparative Examples 1-3 were extruded into a round bar having a diameter of 80 mm using an extruder and cut into a certain length, and then subjected to hot forging and solution treatment.

Each obtained sample was inspected to determine whether or not cracks and/or aperture defects are present in the sample surface in accordance with a solvent removal Penetrant Test (color check) defined by JIS Z 2343-1.

Each sample was cut and the cross-section was polished to perform microstructure observation. The average grain diameter of the crystallized substances was measured.

Thereafter, the polished sample was etched and observed under a metallographic microscope to measure the DAS.

Furthermore, each sample was observed under a metallographic microscope in which a polarization glass was inserted in the optical path to determined whether or not coarse recrystallization is present on the surface and the inside thereof.

Further, JIS 14A comparative test pieces were obtained from a direction (L direction) parallel to the longitudinal direction of the original material and a direction (LT direction) perpendicular to the longitudinal direction to measure the tensile strength, the 0.2% yield strength, and the elongation after fracture.

As the index showing the tear fracture, the characteristic deterioration rate in the LT direction with respect to the L direction was calculated.

These test results are shown together in Table 2.

TABLE 2

| | | Cracks, Aperture defects | Average grain diameter of crystallized substance | DAS | Coarse recrystallization Surface | Coarse recrystallization Inside | Tensile strength L | Tensile strength LT | Tensile strength LT/L | 0.2% yield strength L | 0.2% yield strength LT | 0.2% yield strength LT/L | elongation after fracture L | elongation after fracture LT | elongation after fracture LT/L |
|---|---|---|---|---|---|---|---|---|---|---|---|---|---|---|---|
| Example | 1 | Nil | 6.8 μm | 32 μm | Nil | Nil | 510 | 505 | 0.98 | 455 | 450 | 0.99 | 13.5 | 13.6 | 1.00 |
| | 2 | Nil | 7.0 μm | 29 μm | Nil | Nil | 525 | 530 | 1.01 | 470 | 475 | 1.01 | 12.7 | 12.5 | 0.98 |
| | 3 | Nil | 6.5 μm | 31 μm | Nil | Nil | 475 | 465 | 0.98 | 420 | 425 | 1.01 | 15.3 | 15.1 | 0.99 |
| | 4 | Nil | 7.0 μm | 28 μm | Nil | Nil | 490 | 490 | 1.00 | 440 | 445 | 1.01 | 14.7 | 14.5 | 0.99 |
| Comparative Example | 1 | Nil | 12.5 μm | 35 μm | Existed | Existed | 510 | 475 | 0.94 | 445 | 410 | 0.92 | 14.8 | 8.5 | 0.57 |
| | 2 | Nil | 12.2 μm | 68 μm | Existed | Existed | 530 | 480 | 0.91 | 450 | 410 | 0.91 | 13.6 | 7.9 | 0.58 |
| | 3 | Nil | 12.3 μm | 45 μm | Existed | Existed | 495 | 450 | 0.91 | 415 | 370 | 0.89 | 16.9 | 8.7 | 0.51 |
| | 4 | cracks | 12.2 μm | 31 μm | Nil | Nil | Incapable measurement because of generation of cracks | | | | | | | | |
| | 5 | cracks | 15.0 μm | 28 μm | Nil | Nil | 525 | 530 | 1.01 | 470 | 475 | 1.01 | 8.5 | 8.2 | 0.96 |
| | 6 | Nil | 6.8 μm | 31 μm | Nil | Nil | 435 | 440 | 1.01 | 375 | 380 | 1.01 | 16.8 | 17.1 | 1.02 |
| | 7 | Nil | 7.0 μm | 28 μm | Existed | Nil | 490 | 490 | 1.00 | 430 | 425 | 0.99 | 14.9 | 15.2 | 1.02 |
| | 8 | Nil | 7.0 μm | 28 μm | Insufficient miniaturization of ingot | | 490 | 490 | 1.00 | 430 | 425 | 0.99 | 8.3 | 8.4 | 1.01 |
| | 9 | Aperture defects | 6.8 μm | 32 μm | Nil | Nil | Incapable measurement because of generation of aperture defects | | | | | | | | |
| | 10 | Aperture defects | 6.8 μm | 32 μm | Nil | Nil | Incapable measurement because of generation of aperture defects | | | | | | | | |
| | 11 | Nil | 6.8 μm | 32 μm | Nil | Nil | 410 | 415 | 1.01 | 350 | 355 | 1.01 | 14.5 | 14.2 | 0.98 |

<Evaluation>

As to Examples 1-4, they satisfy all features of the present invention. Therefore, no crack and/or aperture defects were generated in each sample, and no coarse recrystallization was found. Further, as to the tensile strength, 0.2% yield strength, and the elongation after fracture, excellent characteristics could be obtained. The characteristic deterioration rate in the LT direction with respect to the L direction was slight, and had no practical issue.

Furthermore, as to the forged samples (forged products) of Examples 1-4, generation of coarse crystal grains having an average grain diameter of 500 μm or more could have been prevented. In other words, a macro pattern constituted by minute crystal grains hard to visual recognition could be obtained, and the surface color tone was excellent.

On the other hand, in Comparative Examples 1-3, since extruded articles different from continuous cast articles were used as forging materials, coarse recrystallizations were created on the surface and inside, and the tensile strength in the LT direction with respect to the L direction, the 0.2% yield strength, and the elongation after fracture were deteriorated. Especially, the deterioration degree of the elongation after fracture was large.

In Comparative Example 4, since the additive contents of Fe and Mn were excessive, Al—Fe—Mn series coarse recrystallization substances were created, and the average grain diameter of the crystallized substances was large. Thus, cracks occurred starting from the crystallized substances during hot forging.

In Comparative Example 5, since the additive contents of Si were excessive, Al—Si eutectic was created, and the average grain diameter of the crystallized substances was large. Thus, elongation after fracture was deteriorated substantially.

In Comparative Example 6, since the additive contents of Cu and Mg were too low and the Cu/Mg ratio did not meet the condition of 8 or less, the tensile strength and the 0.2% yield strength were remarkably deteriorated.

In the Comparative Example 7, since the additive contents of Mn and Z were too low, coarse recrystallization occurred at the surface portion.

In the Comparative Example 8, since the Ti additive contents was low and the Ti/Zr ratio did not meet the condition of 0.3 or more, the miniaturization was insufficient during the casting, which resulted in deteriorated elongation after fracture.

In the Comparative Example 9, since the homogenization treatment temperature was excessively high, eutectic melting occurred, which caused aperture defects on the surface of the sample (forged product).

In the Comparative Example 10, since the forging temperatures was excessively high, eutectic melting occurred, which caused aperture defects on the surface of the sample (forged product).

In the Comparative Example 11, since the solution treatment temperature was too low, solid solution of precipitation strengthening elements was not sufficiently performed, which caused lack of precipitation amount. Thus, the tensile strength and the 0.2% yield strength were deteriorated.

As will be understood from the above, according to the aluminum alloy forging material and forged product that satisfy the features of the present invention, since the alloy composition, casting conditions, homogenization treatment conditions, forging temperatures, solution treatment temperatures, etc., are adjusted, a high strength aluminum alloy forging material and forged product excellent in tear fracture performance and surface color tone could be obtained.

This application claims priority to Japanese Patent Application No. 2007-330067 filed on Dec. 21, 2007, and the entire disclosure of which is incorporated herein by reference in its entirety.

It should be understood that the terms and expressions used herein are used for explanation and have no intention to be used to construe in a limited manner, do not eliminate any equivalents of features shown and mentioned herein, and allow various modifications falling within the claimed scope of the present invention.

While the present invention may be embodied in many different forms, a number of illustrative embodiments are described herein with the understanding that the present disclosure is to be considered as providing examples of the principles of the invention and such examples are not intended to limit the invention to preferred embodiments described herein and/or illustrated herein.

While illustrative embodiments of the invention have been described herein, the present invention is not limited to the various preferred embodiments described herein, but includes any and all embodiments having equivalent elements, modifications, omissions, combinations (e.g., of aspects across various embodiments), adaptations and/or alterations as would be appreciated by those in the art based on the present disclosure. The limitations in the claims are to be interpreted broadly based on the language employed in the claims and not limited to examples described in the present specification or during the prosecution of the application, which examples are to be construed as non-exclusive.

INDUSTRIAL APPLICABILITY

The aluminum alloy forging material of the present invention can be applied to the forging technology for producing a high quality aluminum alloy forged product.

The invention claimed is:

1. A method of manufacturing an aluminum alloy forging material, comprising:

obtaining an aluminum alloy ingot having a structure in which a secondary dentrite arm spacing (DAS) is 40 μm or less and an average grain diameter of crystallized substances is 8 μm or less by continuously casting a molten aluminum alloy having an aluminum composition consisting of: Si: 0.80 to 1.15 mass %; Fe: 0.2 to 0.5 mass %; Cu: 3.8 to 5 mass %; Mn: 0.8 to 1.15 mass %; Mg: 0.5 to 0.8 mass %; Zr: 0.05 to 0.13 mass %; and Ti contained in such an amount that a sum of Ti and Zr is 0.2 mass % or less, and the balance being Al and inevitable impurities, wherein the alloy composition satisfies a Cu/Mg ratio of 8 or less, Ti is added in a form of a 5Ti-1B mother alloy, and Ti/Zr ratio satisfies 0.3 or higher;

obtaining an aluminum alloy cast product by subjecting the aluminum alloy ingot to homogenization treatment for holding the product for one hour or more at temperatures of 450 to 510° C., hot forging the aluminum alloy cast product under temperature conditions of 400 to 510° C., subjecting the aluminum alloy cast product to a solution treatment under temperature conditions of 450 to 510° C., and subjecting the aluminum alloy cast product to an aging treatment, wherein the aluminum alloy cast product is constituted as the aluminum alloy forging material.

* * * * *